US008813849B1

(12) United States Patent
Davis

(10) Patent No.: US 8,813,849 B1
(45) Date of Patent: Aug. 26, 2014

(54) OIL WELL SAFETY VALVE APPARATUS AND METHOD

(76) Inventor: Raymond C. Davis, Lake Charles, LA (US)

( * ) Notice: Subject to any disclaimer, the term of this patent is extended or adjusted under 35 U.S.C. 154(b) by 385 days.

(21) Appl. No.: 13/162,249

(22) Filed: Jun. 16, 2011

Related U.S. Application Data

(60) Provisional application No. 61/361,204, filed on Jul. 2, 2010, provisional application No. 61/356,905, filed on Jun. 21, 2010.

(51) Int. Cl.
*E21B 34/12* (2006.01)

(52) U.S. Cl.
USPC ..... 166/329; 166/332.4

(58) Field of Classification Search
USPC ..... 166/329, 332.6, 332.4; 137/516.11, 137/528, 519.5, 533.11; 251/149.1, 149.3
See application file for complete search history.

(56) References Cited

U.S. PATENT DOCUMENTS

| | | | | | |
|---|---|---|---|---|---|
| 193,605 | A | | 7/1877 | Hay | |
| 1,034,995 | A | * | 8/1912 | Gannon | 266/269 |
| 1,124,933 | A | * | 1/1915 | McCumber | 251/149.3 |
| 2,249,172 | A | * | 7/1941 | Quintrell | 166/125 |
| 3,269,463 | A | | 8/1966 | Page | |
| 3,568,768 | A | | 3/1971 | Rowell, Jr. et al. | |
| 3,850,191 | A | | 11/1974 | Brown | |
| 3,850,194 | A | * | 11/1974 | Brown | 137/496 |
| 4,069,840 | A | | 1/1978 | Brown et al. | |
| 4,108,203 | A | | 8/1978 | Brown | |
| 4,171,019 | A | | 10/1979 | Cole | |
| 4,263,936 | A | * | 4/1981 | Brown | 137/496 |
| 4,266,605 | A | * | 5/1981 | LaBorde et al. | 166/97.1 |
| 4,577,614 | A | | 3/1986 | Schoeffler | |
| 4,694,855 | A | | 9/1987 | Cunningham | |
| 5,086,802 | A | * | 2/1992 | Spears | 137/68.11 |
| 5,261,895 | A | * | 11/1993 | Kablik | 604/249 |
| 6,966,368 | B2 | | 11/2005 | Farquhar | |
| 7,100,700 | B2 | | 9/2006 | Davis et al. | |
| 2008/0053660 | A1 | | 3/2008 | Angman | |

* cited by examiner

*Primary Examiner* — Kenneth L Thompson
(74) *Attorney, Agent, or Firm* — Garvey, Smith, Nehrbass & North, L.L.C.; Charles C. Garvey, Jr.; Vanessa M. D'Souza

(57) ABSTRACT

An oil well control device automatically shuts in a well responsive to the removal of a work string (or other removable structure—ball retarding structure) from the device. The device is placed in the well as a section of the well casing. The device provides a pair of bores, one that aligns with the well bore or well casing, the other being a branch flow line containing a ball structure that will close the well if the drill pipe or drill string is removed. While conducting normal well activity (e.g. drilling, work over or the like) the ball retarder (e.g. work string) prevents entry of the ball structure into the main flow channel.

26 Claims, 4 Drawing Sheets

OIL WELL SAFETY VALVE APPARATUS AND METHOD

CROSS-REFERENCE TO RELATED APPLICATIONS

This is a non provisional patent application of U.S. Provisional Patent Application Ser. No. 61/356,905, filed Jun. 21, 2010, and U.S. Provisional Patent Application Ser. No. 61/361,204, filed Jul. 2, 2010.

Priority of U.S. Provisional Patent Application Ser. No. 61/356,905, filed Jun. 21, 2010, and U.S. Provisional Patent Application Ser. No. 61/361,204, filed Jul. 2, 2010, each of which is incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to an oil well safety device that automatically shuts in or closes an oil well if the drill string is removed or responsive to removal of the drill string to a position above the safety device.

2. General Background of the Invention

In the exploration of oil, wells are drilled many thousands of feet into the earth. Tremendous pressures can exist in formations where oil is located. Drillers use heavy fluids such as drilling mud to control well pressures and prevent a catastrophic blow out wherein oil and gas escape from the well bore.

There are various control devices that hopefully close the well bore before a blow out can occur. Examples include blow out preventers, sub surface valves, sub surface safety valves and the like. Most such safety control devices require activation by personnel on a drilling structure. If these valve blow out preventers or valve structures cannot be actuated, blow out still occurs.

BRIEF SUMMARY OF THE INVENTION

The present invention provides an improved oil control device that automatically shuts in a well responsive to the removal of a drill string from the device. The device is thus placed in the well as a section of the well casing. The device provides a pair of bores, one that aligns with the well bore or well casing, the other being a branch flow line containing a ball structure that will close the well if the drill pipe or drill string is removed. While drilling, the drill string prevents entry of the ball structure into the main flow channel.

The present invention thus provides an oil safety shut off method. As part of the method, there is provided a section of well casing having a well bore and the casing including a device having a first flow bore of a first diameter aligned generally with the well bore of the casing. In this fashion, flow through the casing also flows through the first flow bore with a first diameter.

A second flow bore is provided that communicates with the first bore at two spaced apart positions to provide a lower flow entry from the first flow bore and an upper flow discharge into the first flow bore, the second flow bore having a diameter that is larger than the first diameter.

There is an upper ball seat above the upper flow discharge.

A lower ball seat is provided in the second flow bore in between the lower flow entry and the upper flow discharge.

A ball valving member is contained in the second flow bore above the lower seat.

The method disallows entry of the ball valving member into the first flow bore by placing a ball retarding member in the first flow bore. The ball retarding member can occupy a position within the first flow bore next to the upper flow discharge.

A removal of the ball retarding member enables the ball valving member to form a seal with the upper ball seat, slowing the flow of fluids upwardly in the first flow bore.

In one embodiment, the ball retarding member can be a work string.

In one embodiment, the ball retarding member can be a drill string.

In one embodiment, the ball retarding member can be a tube or tubing.

In one embodiment, the ball retarding member can be a member that extends to a work deck, drill deck, platform, work vessel, or earth surface area.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 6:
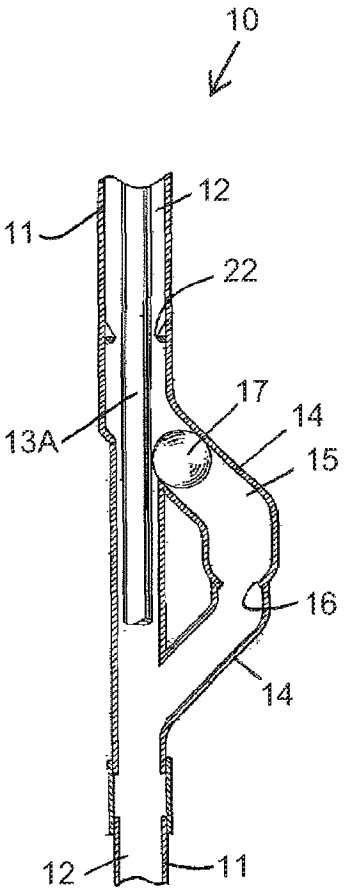
FIGS. 4-6 are sectional elevation views of a preferred embodiment of the apparatus of the present invention and illustrating the method of the present invention.
Figure 7:
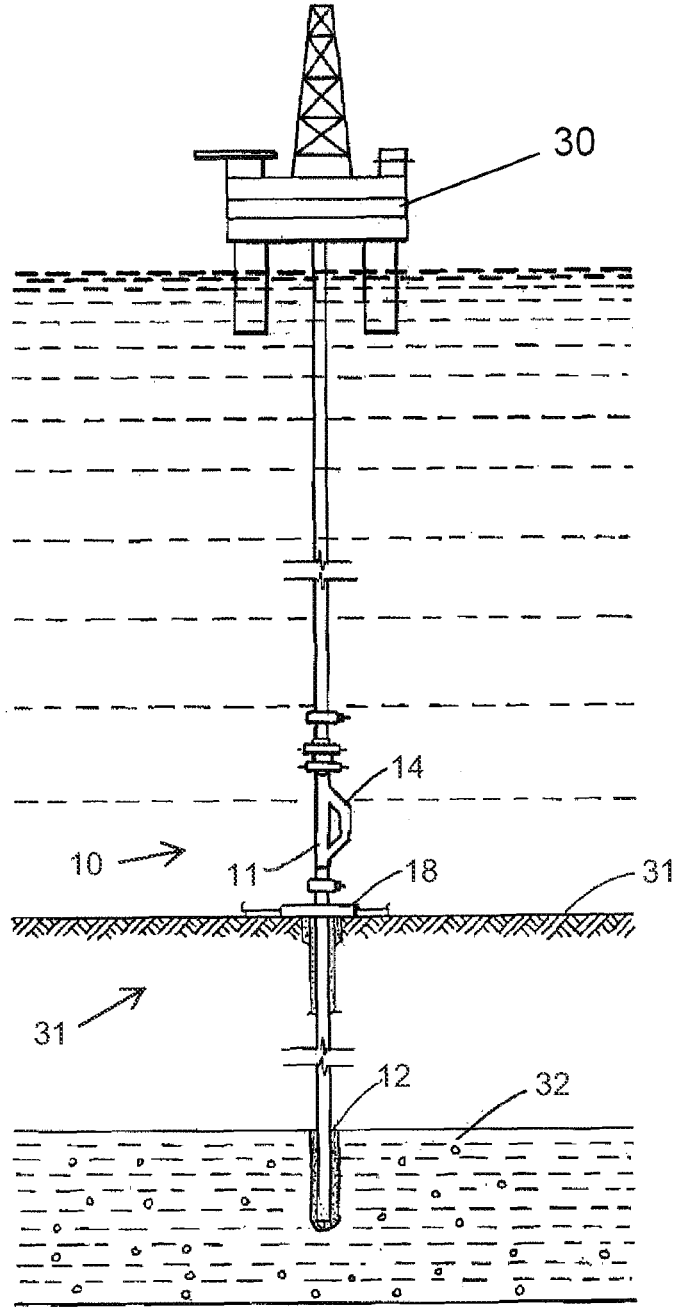
FIG. 7 is a sectional elevation view of a preferred embodiment of the apparatus of the present invention.

Oil well safety shut off apparatus is shown in FIGS. 1-7, designated generally by the numeral 10. Oil well safety shut off apparatus 10 can be used in a well casing 11 that surrounds a well bore 12 and blow out preventer (BOP) 18. In FIG. 7, a marine use is shown with drill ship 30, casing 11, blow out preventer 18 and seabed 31. Oil producing formation 32 is below seabed 31.

A drill string, work string or other string 13 extends downwardly into the well bore 12 and through the first bore 23 of the device 10. Circulating mud 21 can be located in first bore 23. First bore 23 has a diameter d1 designated by the numeral 19. Diameter 19 of first bore 23 and the diameter of the well bore (i.e. casing 11 internal diameter) can be equal (see FIG. 7).

A branch flow line 14 has a bore 15 with a diameter (d2) designated by the numeral 20 and larger than the diameter designated by the numeral 19. The branch flow line 14 communicates with the first bore 23 at two spaced apart positions, namely lower opening 24 and upper opening 25. A ball structure 17 is carried in branch flow line bore 15 in between openings 24, 25 as shown. There is a lower seat 16 that prevents downward movement of ball valving member 17. There is an upper seat 22 or seal ring that prevents upward movement of valving member 17 should work string (or other ball retarding member) be removed from bores 12, 23 to a position above opening 25 and seat 22. First bore 23 can have a guide 27. Guide 27 can be used to help track the ball structure 17 during its travel.

Figure 1:
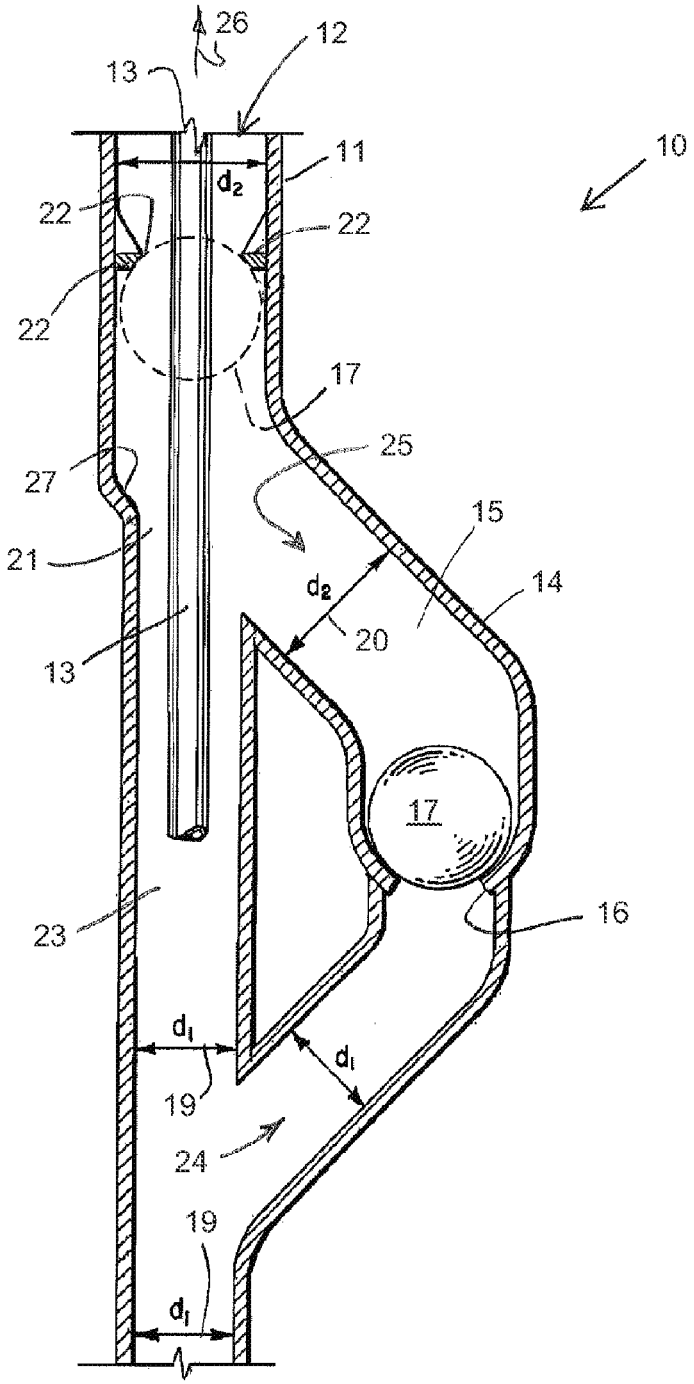
FIG. 1 is a sectional elevation view of a preferred embodiment of the apparatus of the present invention.
Figure 2:
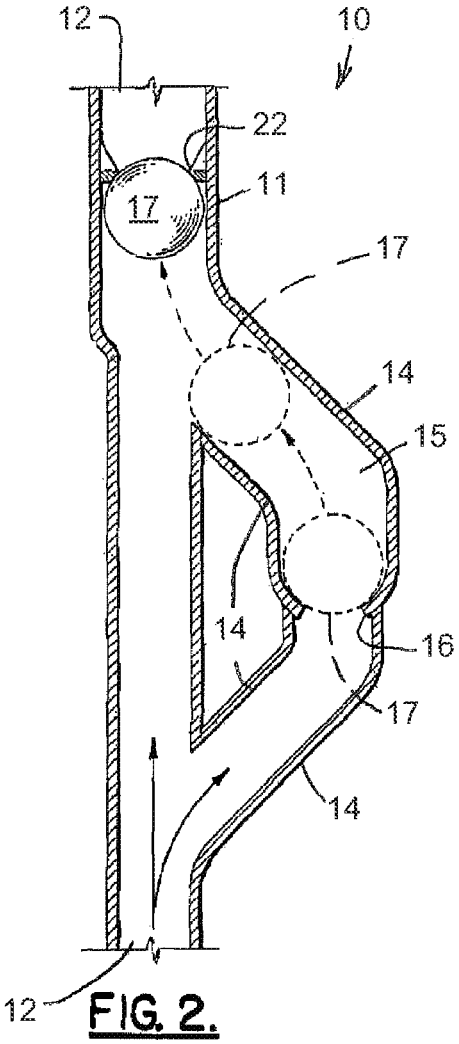
FIG. 2 is a sectional elevation view of a preferred embodiment of the apparatus of the present invention.
Figure 3:
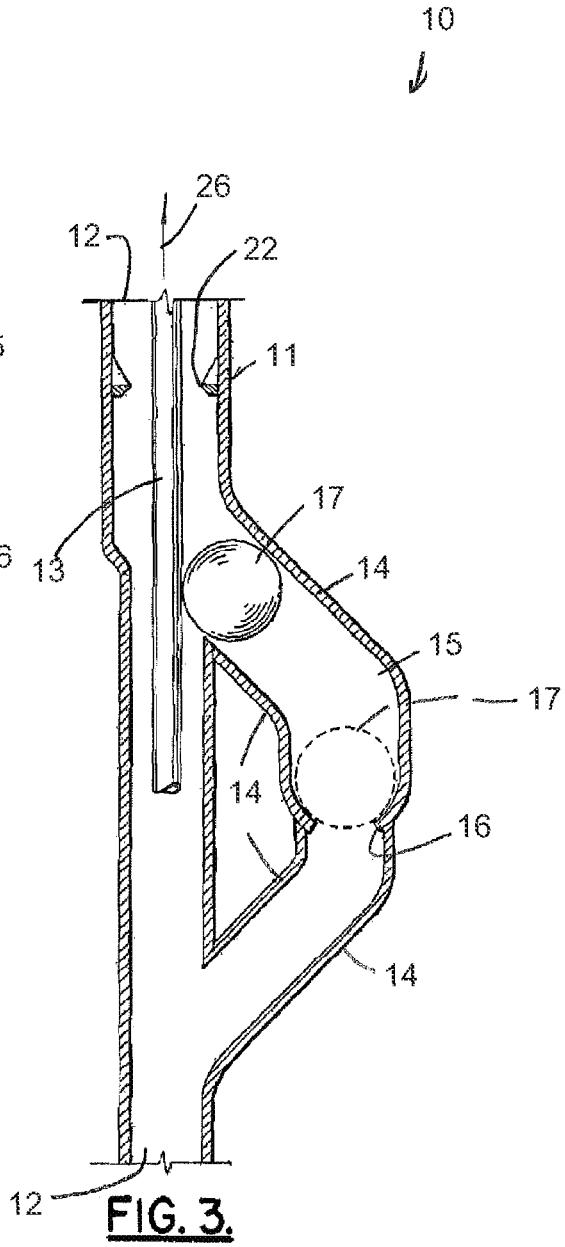
FIG. 3 is a sectional elevation view of a preferred embodiment of the apparatus of the present invention.
Figure 5:
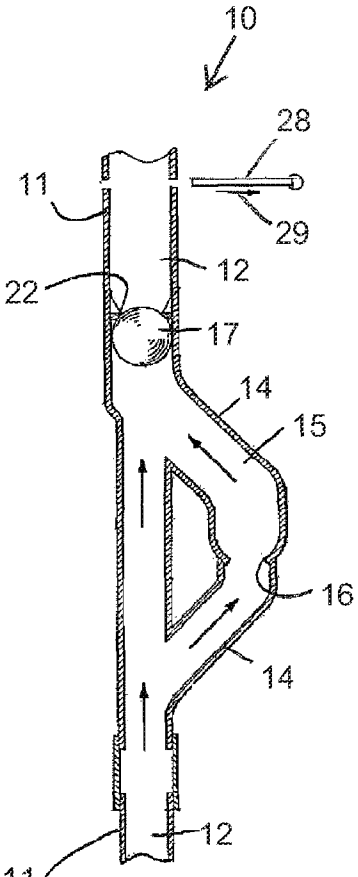
Figure 4:
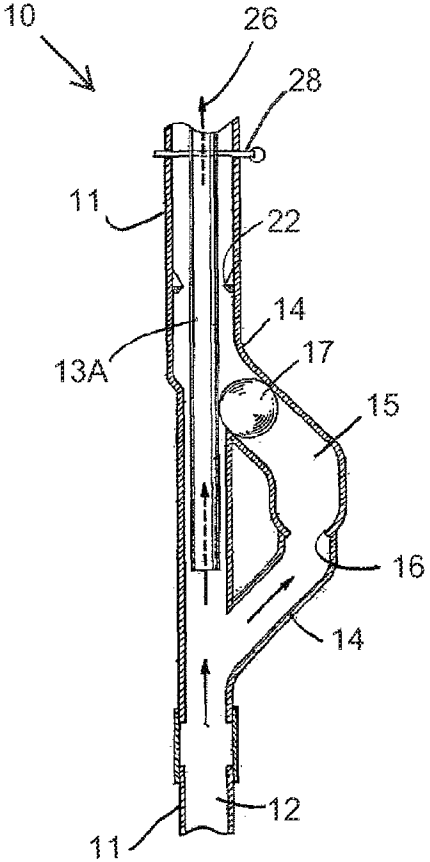

During normal well activity, ball retarding structure or work string 13 prevents entry of ball 17 into bore 12 or 23 (see FIGS. 1 and 3). If a blow out condition seems likely, the operators would pull work string 13 upwardly in the direction of arrow 26 in FIG. 4 and past seat or seal ring 22. This action frees ball 17 to seal with seat or seal ring 22. Because diameter 20 is larger than diameter 19, fluid flow traveling into branch flow line bore 15 will push ball 17 upwardly and into contact with upper seat or seal 22 (see FIGS. 2-6). In FIGS. 4-6, an alternate arrangement provides a section of tubing or drill string 13A held in position in FIG. 4 with pin 28. In FIG. 5, pin 28 is removed as indicated by arrow 29. An ROV or remotely operated vehicle could be used to remove pin 28 and then remove drill string section 13A.

The following is a list of suitable parts and materials for the various elements of a preferred embodiment of the present invention.

PARTS LIST

| Part Number | Description |
|---|---|
| 10 | oil well safety shut off apparatus |
| 11 | casing |
| 12 | well bore |
| 13 | work string/drill string |
| 13A | section of string/tubing |
| 14 | branch flow line |
| 15 | branch flow line bore |
| 16 | lower seal seat |
| 17 | ball structure |
| 18 | blow out preventer/BOP |
| 19 | well bore diameter (d1) |
| 20 | branch flow line diameter (d2) |
| 21 | circulating mud |
| 22 | upper seal seat/seal ring |
| 23 | first bore of device |
| 24 | lower opening |
| 25 | upper opening |
| 26 | arrow |
| 27 | guide |
| 28 | pin |
| 29 | arrow |
| 30 | drill ship/wellhead area |
| 31 | seabed |
| 32 | formation |

The foregoing embodiments are presented by way of example only; the scope of the present invention is to be limited only by the following claims.

The invention claimed is:

1. An oil well safety shut off method, comprising the steps of:

a) providing in a section of well casing having a well bore, a device having a first flow bore of a first diameter aligned generally with the well bore of the casing so that flow through the casing also flows through the first flow bore;

b) providing a second flow bore that communicates with the first bore at two spaced apart positions to provide a lower flow entry from the first flow bore and an upper flow discharge into the first flow bore, the second flow bore having a diameter that is at least in part larger in transverse cross section than the first diameter;

c) providing an upper ball seat in the first flow bore and above the upper flow discharge;

d) providing a lower ball seat in the second flow bore in between the lower flow entry and the upper flow discharge;

e) placing a ball valving member in the second flow bore above the lower seat;

f) disallowing entry of the ball valving member into the first flow bore by placing a ball retarding member in the first flow bore, the ball retarding member occupying a position within the first flow bore and extending above and below the upper flow discharge; and g) a removal of the ball retarding member enabling the ball valving member to form a seal with the upper ball seat, slowing the flow of fluids upwardly in the first flow bore.

2. An oil well safety shut off method, comprising the steps of:

a) providing in a section of well casing having a well bore, a device having a first flow bore of a first diameter aligned generally with the well bore of the casing so that flow through the casing also flows through the first flow bore;

b) providing a second flow bore that communicates with the first bore at two spaced apart positions to provide a lower flow entry from the first flow bore and an upper flow discharge into the first flow bore, the second flow bore having a diameter that is at least in part larger in transverse cross section than the first diameter;

c) providing an upper ball seat above the upper flow discharge;

d) providing a lower ball seat in the second flow bore in between the lower flow entry and the upper flow discharge;

e) placing a ball valving member in the second flow bore above the lower seat;

f) disallowing entry of the ball valving member into the first flow bore by placing a ball retarding member in the first flow bore, the ball retarding member occupying a position within the first flow bore next to the upper flow discharge; and g) a removal of the ball retarding member enabling the ball valving member to form a seal with the upper ball seat, slowing the flow of fluids upwardly in the first flow bore, wherein the ball retarding member is manipulated from a wellhead area.

3. The oil well safety shut off method of claim 2 wherein the ball retarding member extends above and below the upper flow discharge.

4. The oil well safety shut off method of claim 2 wherein the second flow bore has at least one inclined section and in step "f" the ball retarding member does not enter the inclined section.

5. The oil well safety shut off method of claim 4 wherein in step "g" the ball retarding member does not enter the inclined section.

6. The oil well safety shut off method of claim 2 wherein the ball retarding member is a work string that extends from a wellhead area to the device.

7. The oil well safety shut off method of claim 2 wherein the ball retarding member is a string of tubular material that extends from a wellhead area to the device.

8. The oil well safety shut off method of claim 2 wherein the ball retarding member is a string of pipe and further comprising manipulating the string of pipe from a wellhead area.

9. The oil well safety shut off method of claim 2 wherein the ball retarding member is a string of pipe and further comprising lifting and lowering the string of pipe.

10. The oil well safety shut off method of claim 2 wherein the ball retarding member is a work string and further comprising the step of lifting and lowering the work string.

11. The oil well safety shut off method of claim 2 wherein the ball retarding member is a string of pipe and further comprising lifting and lowering the string of pipe.

12. The oil well safety shut off method of claim 2 wherein the ball retarding member is a string of tubular material and further comprising the step of lifting and lowering the string of tubular material.

13. The oil well safety shut off method of claim 2 further comprising the step of circulating drilling fluid in at least one of the flow bores.

14. An oil well safety shut off method, comprising the steps of:

a) providing in a section of well casing having a well bore, the casing including a device having a first flow bore of a first minimum diameter aligned generally with the bore of the casing so that flow through the casing also flows through the first flow bore;

b) providing a second flow bore that communicates with the first bore at two spaced apart positions to provide a lower flow entry from the first flow bore and an upper flow discharge into the first flow bore, the second flow bore having a portion with a diameter that is larger than the first diameter;

c) providing an upper ball seat above the upper flow discharge;

d) providing a lower ball seat in the second flow bore in between the lower flow entry and the upper flow discharge;

e) placing a valving member in the second flow bore above the lower seat;

f) disallowing entry of the valving member into the first flow bore by placing a work string in the first flow bore, the work string extending above and below the upper flow discharge; and g) a removal of the work string enabling the valving member to form a seal with the upper seat, slowing the flow of fluids upwardly in the first flow bore.

15. The oil well safety shut off method of claim 14 wherein the valving member is a ball valving member.

16. The oil well safety shut off method of claim 14 wherein the second flow bore has an inclined section.

17. The oil well safety shut off method of claim 16 wherein the valving member travels from a position in communication with the inclined section to a position removed from the inclined section in step "g".

18. The oil well safety shut off method of claim 16 wherein the inclined section is above the lower seat.

19. The oil well safety shut off method of claim 14 further comprising the step of lifting and lowering the work string.

20. The oil well safety shut off method of claim 14 wherein the upper seat has a diameter that is about equal to the diameter of the lower seat.

21. The oil well safety shut off method of claim 14 wherein the second flow bore has two spaced apart inclined sections.

22. The oil well safety shut off method of claim 21 wherein the lower seat is in between the spaced apart inclined sections.

23. The oil well safety shut off method of claim 21 wherein the first minimum diameter portion is at an elevation that is in between the spaced apart inclined sections.

24. The oil well safety shut off method of claim 23 wherein the minimum diameter section is a cylinder that is in between the upper seat and the bottom of the lower inclined section.

25. The oil well safety shut off method of claim 16 wherein the valving member exits the inclined section during step "g".

26. The oil well safety shut off method of claim 16 wherein the valving member moves to a position that is above both the minimum diameter section and the inclined section in step "g".

* * * * *